US008124006B2

(12) United States Patent
Mukai et al.

(10) Patent No.: US 8,124,006 B2
(45) Date of Patent: Feb. 28, 2012

(54) LADLE FOR MOLTEN METAL DELIVERY

(75) Inventors: Katsuyoshi Mukai, Higashiosaka (JP); Toshiyuki Matsumoto, Kasugai (JP); Kiyohumi Kawai, Kameyama (JP)

(73) Assignees: Nippon Crucible Co., Ltd., Tokyo (JP); Daiki Aluminium Industry Co., Ltd., Osaka (JP)

( * ) Notice: Subject to any disclaimer, the term of this patent is extended or adjusted under 35 U.S.C. 154(b) by 722 days.

(21) Appl. No.: 12/224,882

(22) PCT Filed: Mar. 23, 2007

(86) PCT No.: PCT/JP2007/055993

§ 371 (c)(1),
(2), (4) Date: Sep. 9, 2008

(87) PCT Pub. No.: WO2007/111243

PCT Pub. Date: Oct. 4, 2007

(65) Prior Publication Data

US 2009/0114685 A1 May 7, 2009

(30) Foreign Application Priority Data

Mar. 24, 2006 (JP) ..... 2006-082515
Apr. 27, 2006 (JP) ..... 2006-123089

(51) Int. Cl.
*C21C 5/42* (2006.01)

(52) U.S. Cl. ..... 266/274; 266/275; 266/236; 222/591; 222/595

(58) Field of Classification Search ..... 222/591–607; 266/45, 229–230, 236, 239, 274–275
See application file for complete search history.

(56) References Cited

U.S. PATENT DOCUMENTS

| | | | | |
|---|---|---|---|---|
| 7,204,954 | B2 | 4/2007 | Mizuno et al. | |
| 7,514,034 | B2 | 4/2009 | Abe et al. | |
| 7,611,664 | B2 * | 11/2009 | Mizuno et al. | 266/236 |
| 2004/0070122 | A1 | 4/2004 | Mizuno et al. | |
| 2007/0152387 | A1 | 7/2007 | Ukaji et al. | |

FOREIGN PATENT DOCUMENTS

| | | |
|---|---|---|
| EP | 1552 894 | 7/2005 |
| EP | 1 702 700 | 9/2006 |
| JP | A-2002-254158 | 9/2002 |
| JP | A-2002-254160 | 9/2002 |
| JP | A-2004-216455 | 8/2004 |
| JP | A-2005-066618 | 3/2005 |

OTHER PUBLICATIONS

PCT International Search Report mailed on Jun. 19, 2007 for the corresponding international patent application No. PCT/JP2007/055993.
European Search Report dated May 13, 2011 issued in corresponding European Patent Application No. 07739434.4.

* cited by examiner

*Primary Examiner* — Roy King
*Assistant Examiner* — Lois Zheng
(74) *Attorney, Agent, or Firm* — Posz Law Group, PLC

(57) ABSTRACT

The molten metal-transferring ladle including a ladle body having a storage space for melted metal, and an opening on the top; a large lid having an inlet in the middle, and covering an upper opening of the ladle body; an openable small lid covering the inlet; a tapping portion communicating the interior with the exterior of the storage space; and a pressurizing gas supplying means supplying a pressurizing gas to the storage space; the large lid having a supplying means installing hole communicating the interior with the exterior of the storage space; and the pressurizing gas supplying means being detachably mounted to the supplying means installing hole.

8 Claims, 12 Drawing Sheets

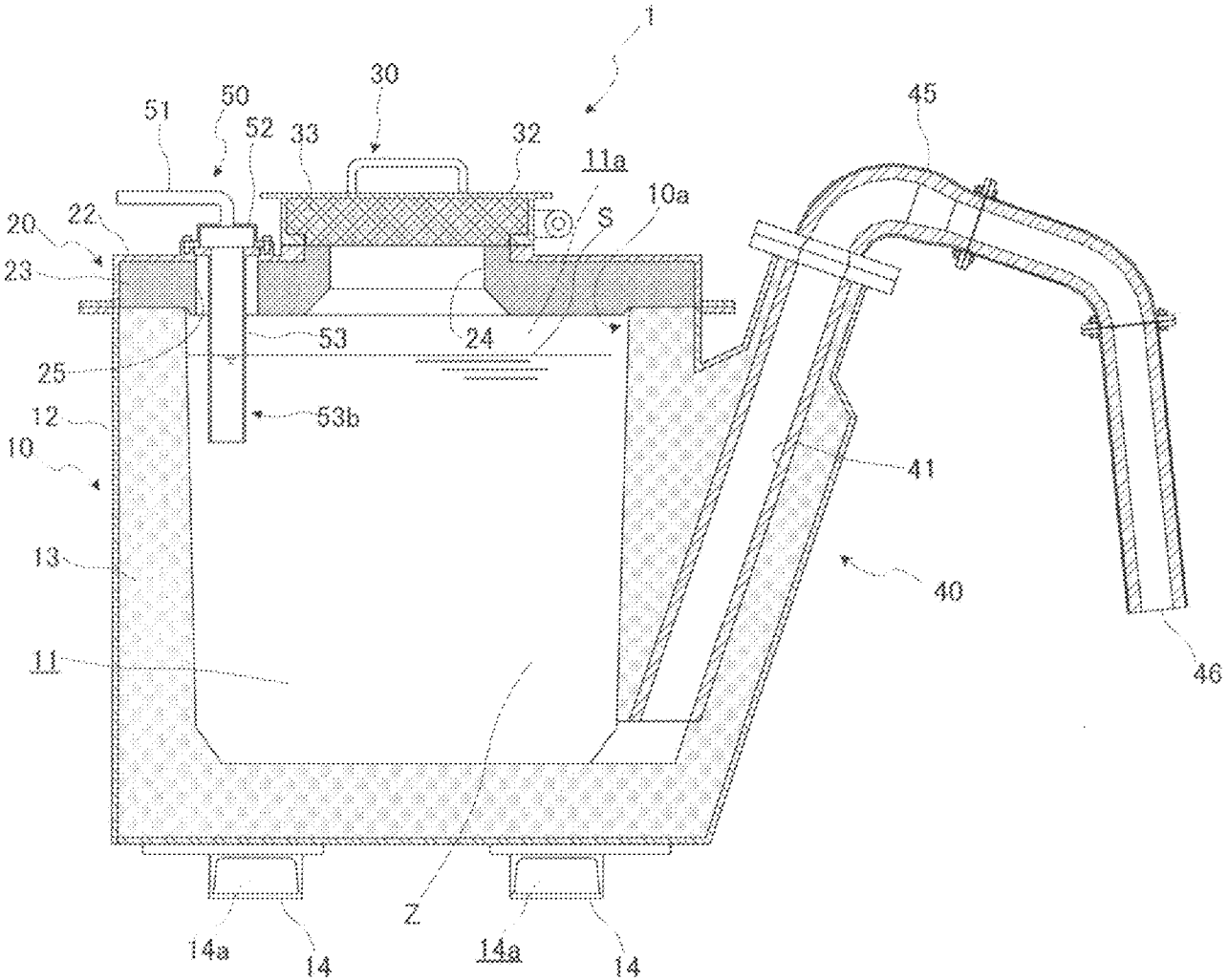
[Fig. 1]

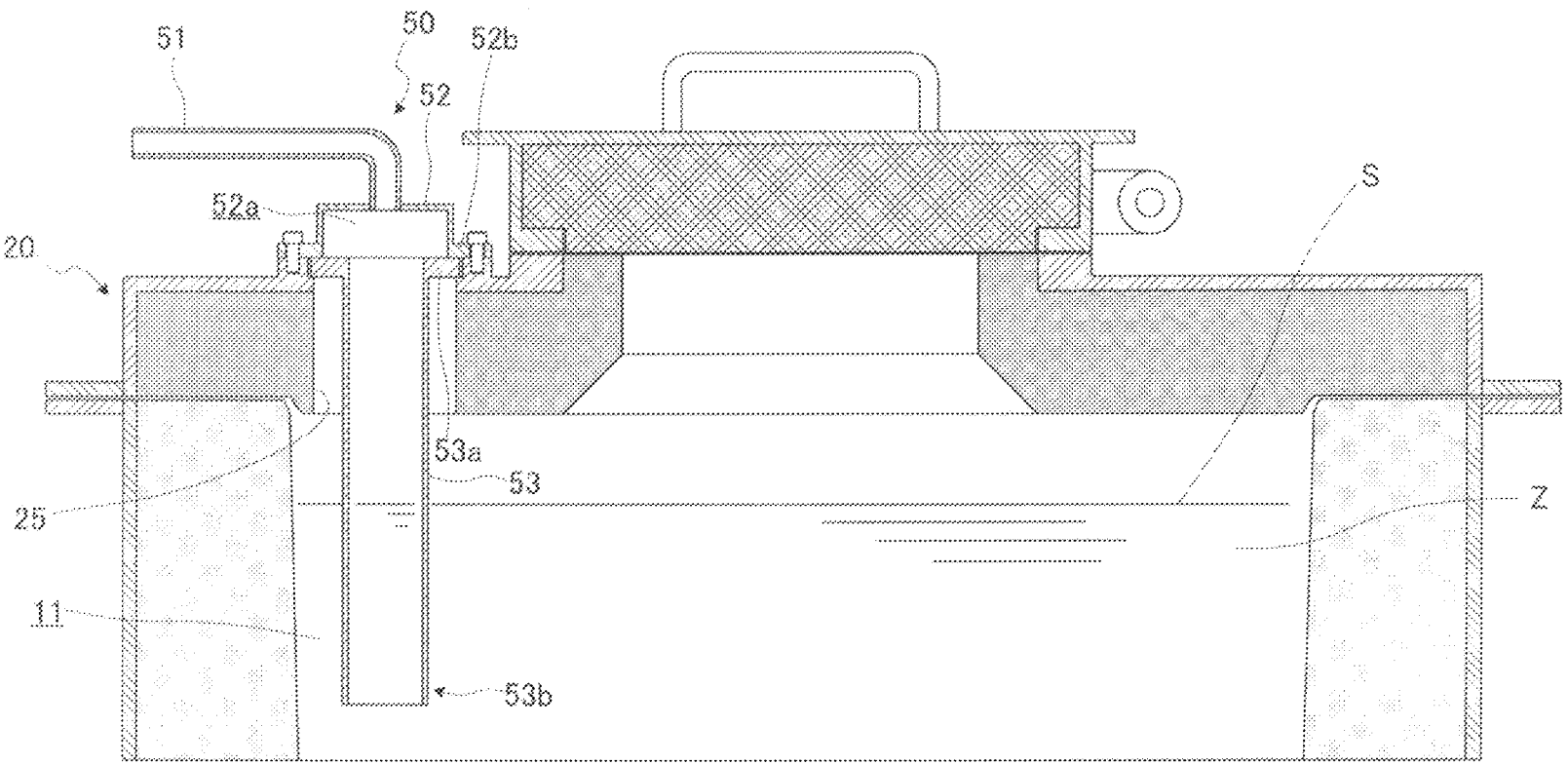
[Fig.2]

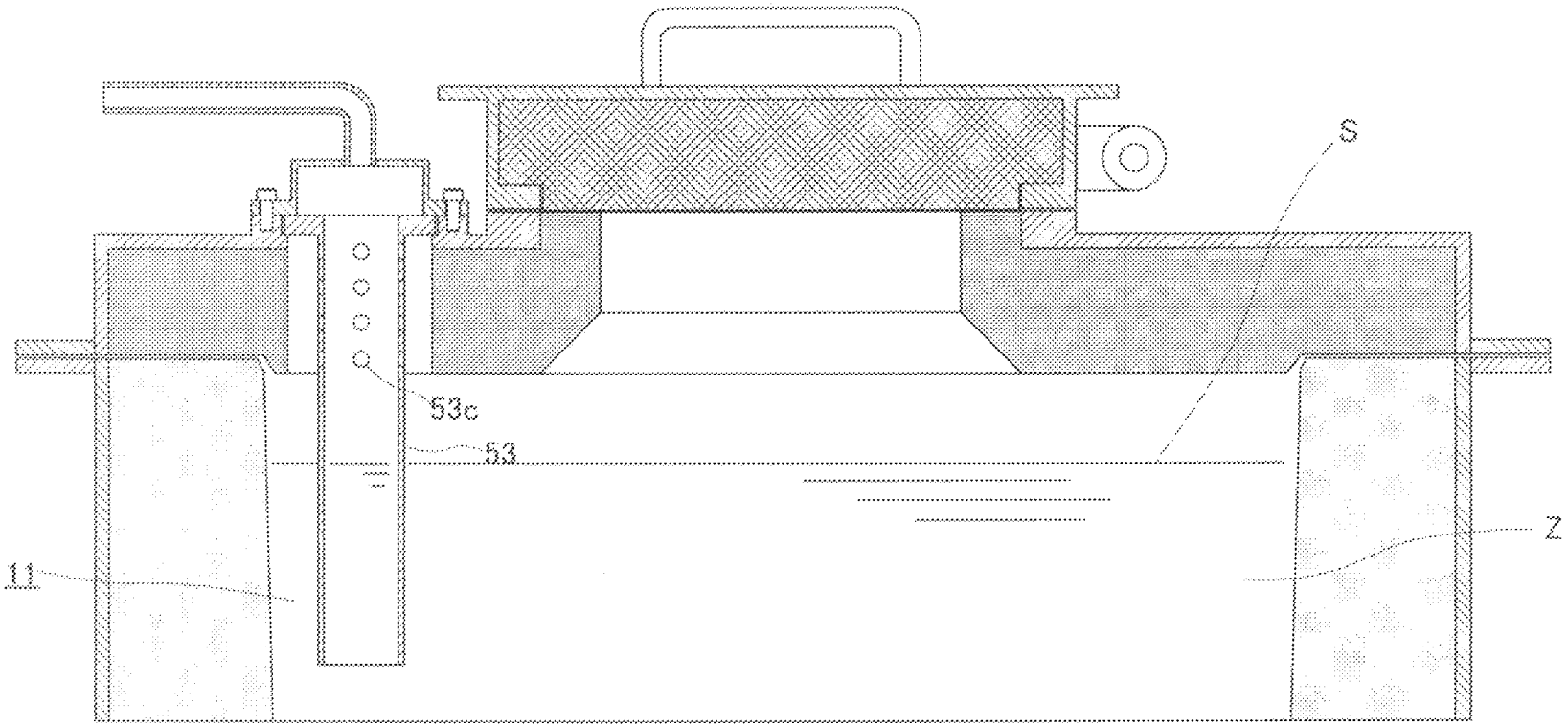
[Fig 3]

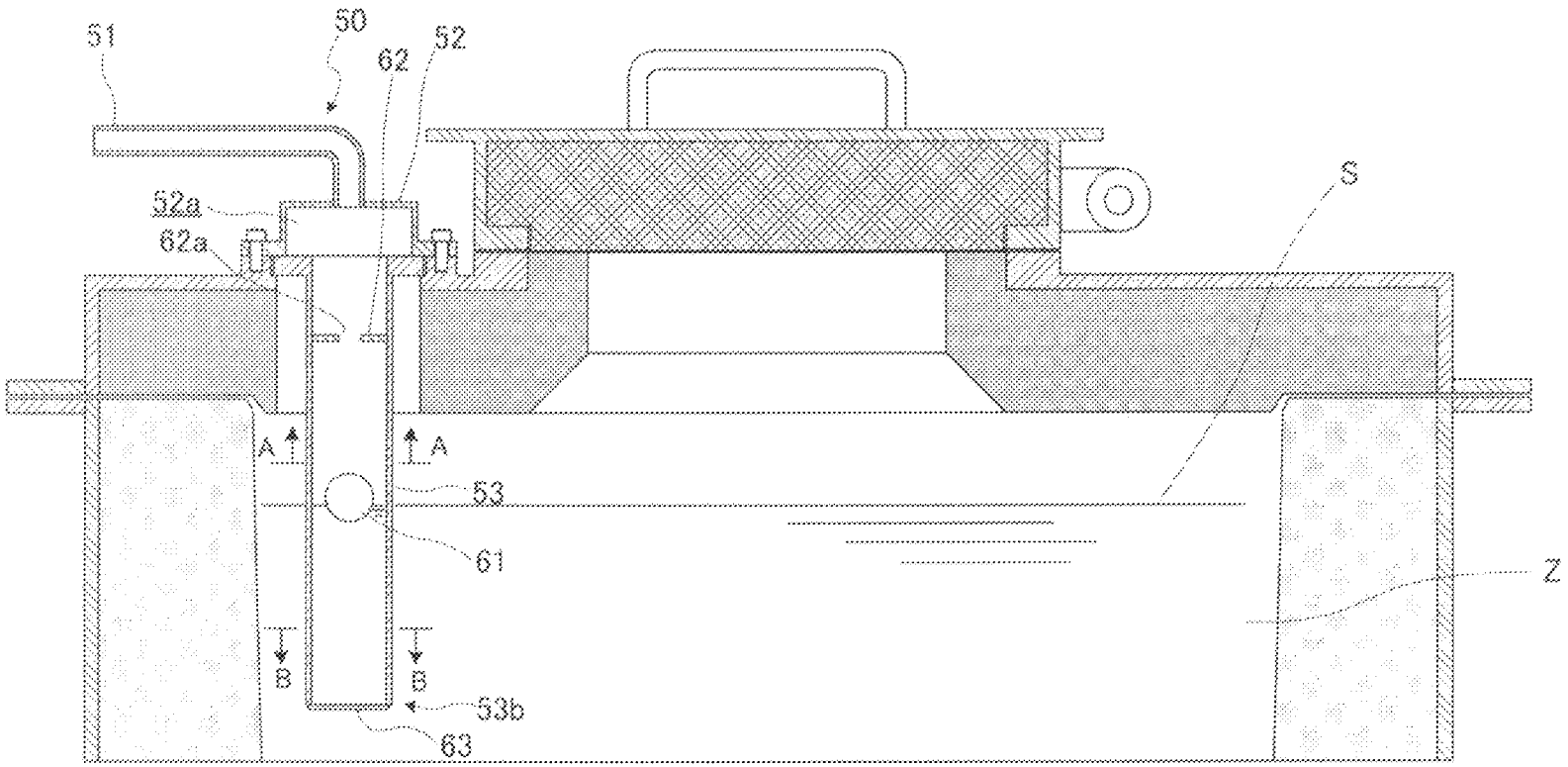
[Fig.4]

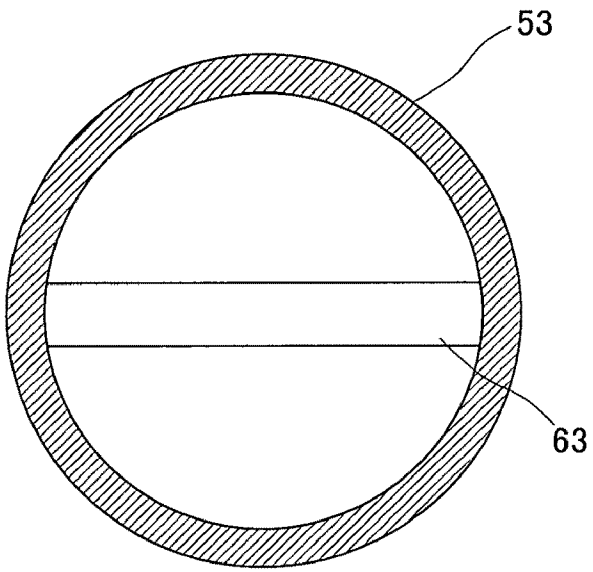
(b)
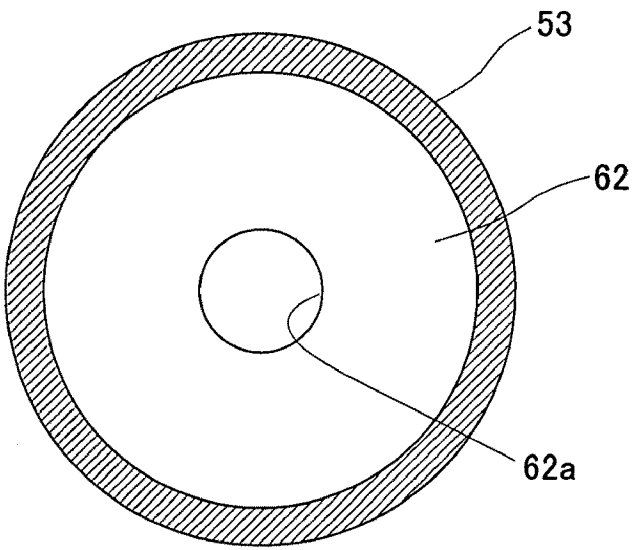
(a)
【Fig.5】

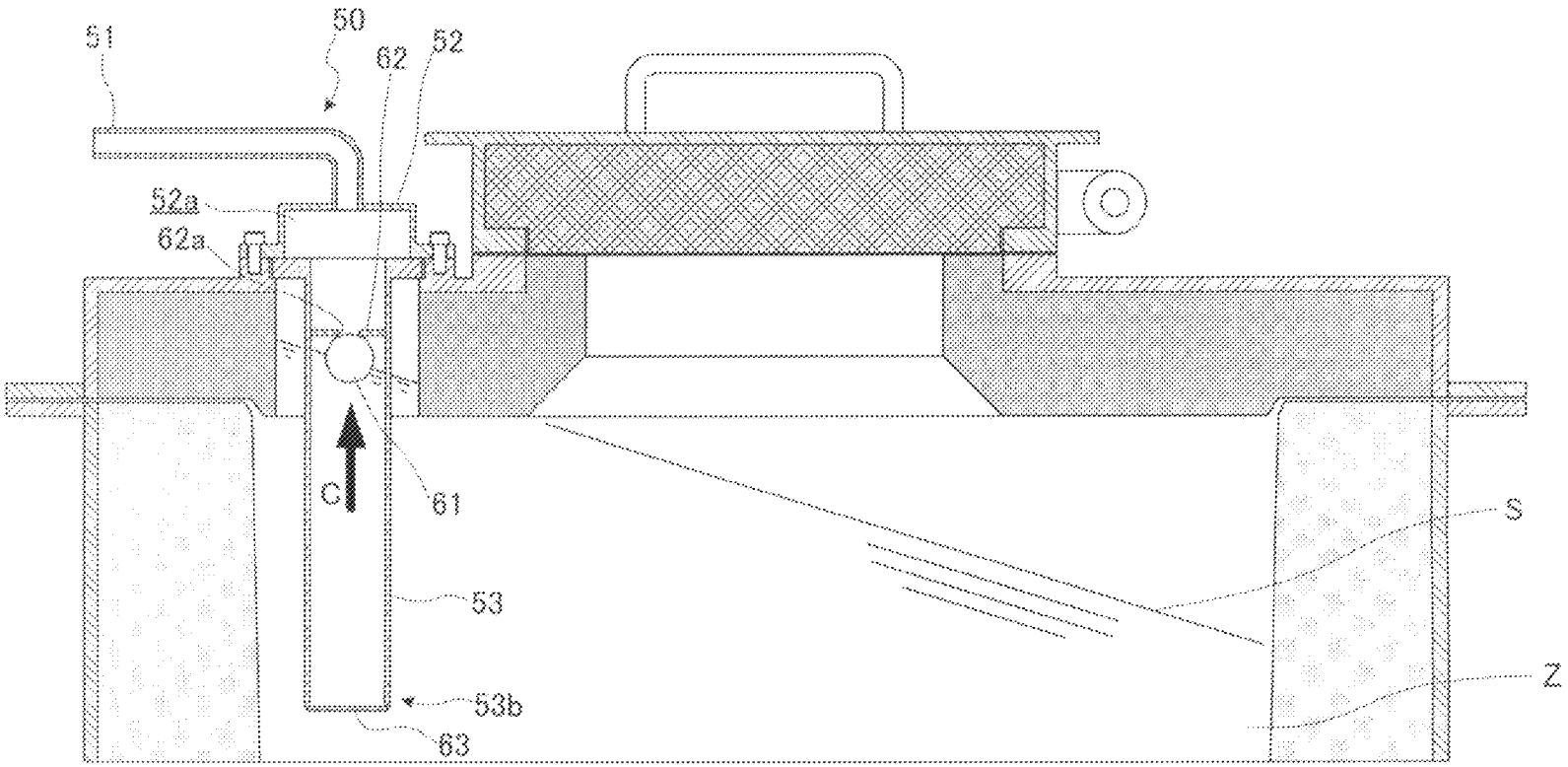
[Fig.6]

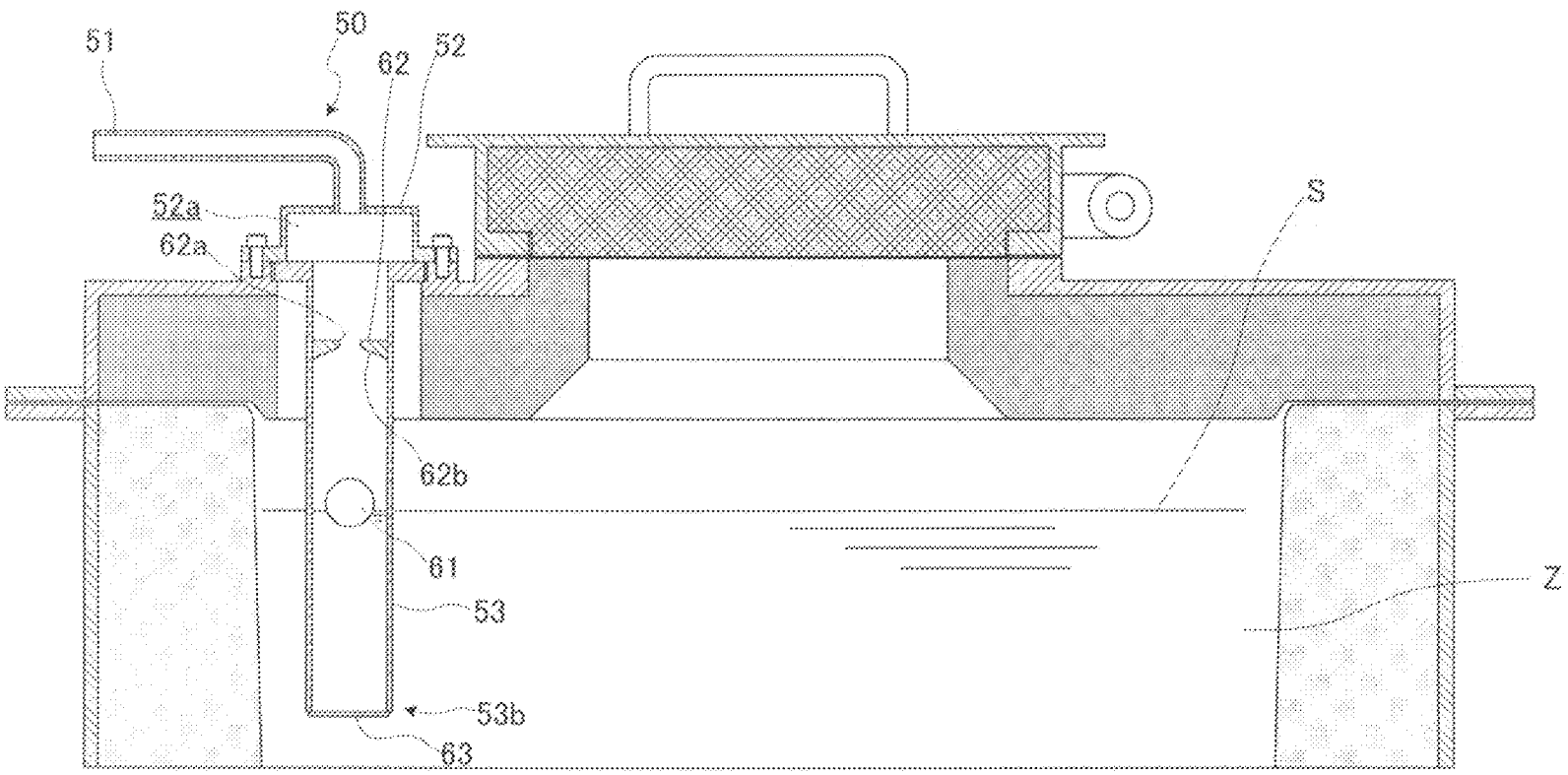
[Fig. 7]

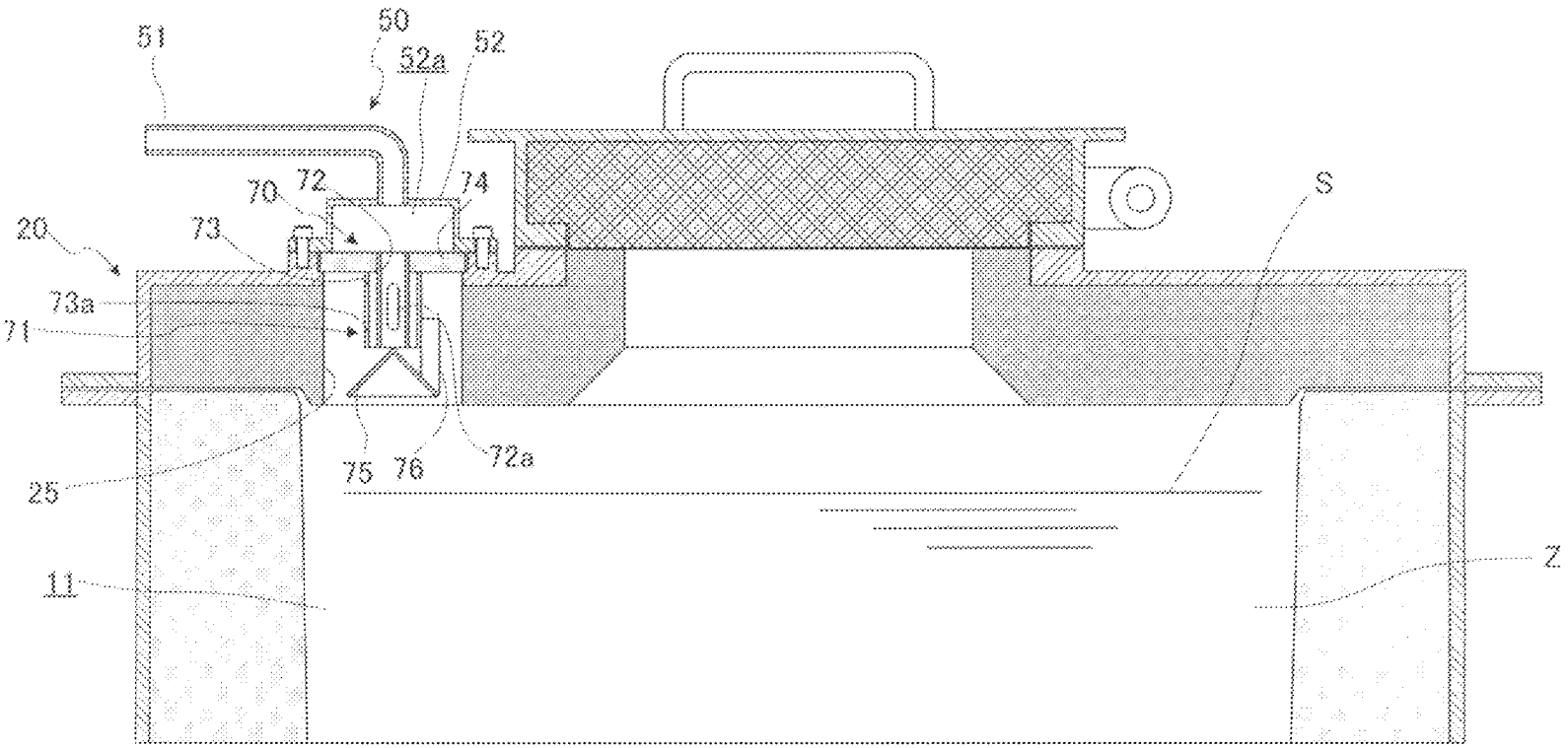
[Fig.8]

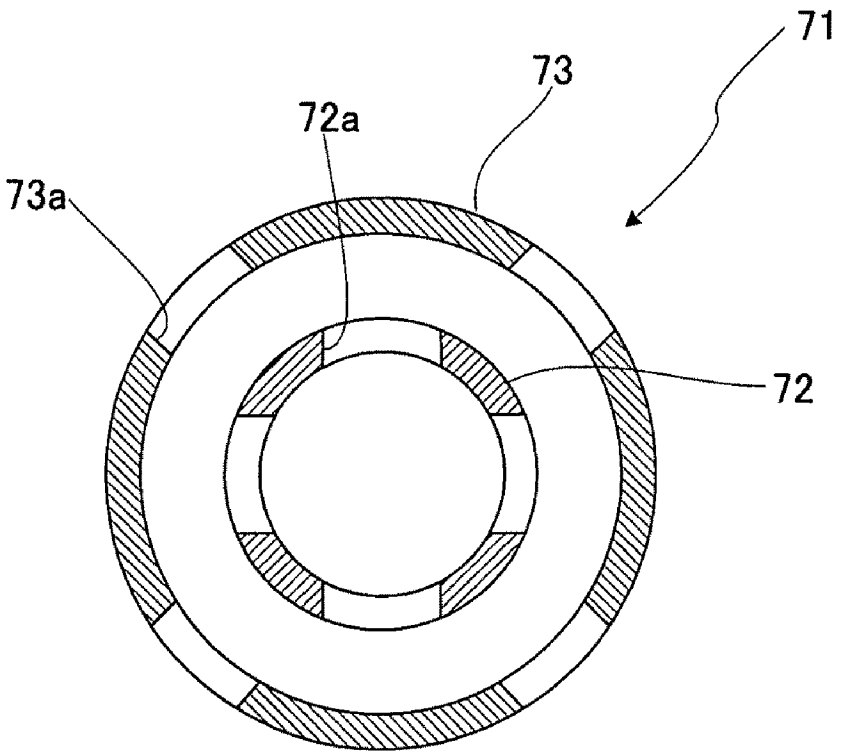
【Fig.9】

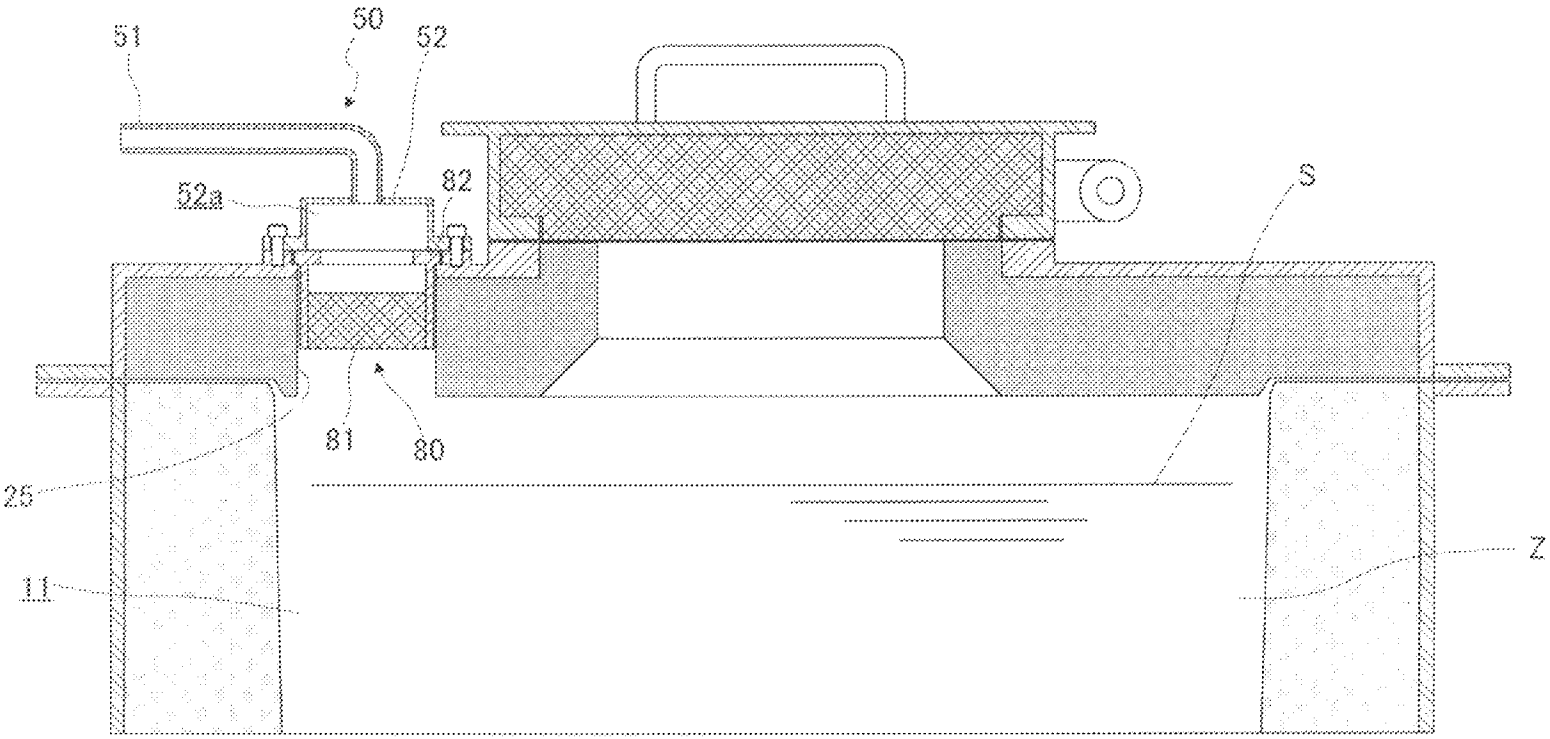
[Fig. 10]

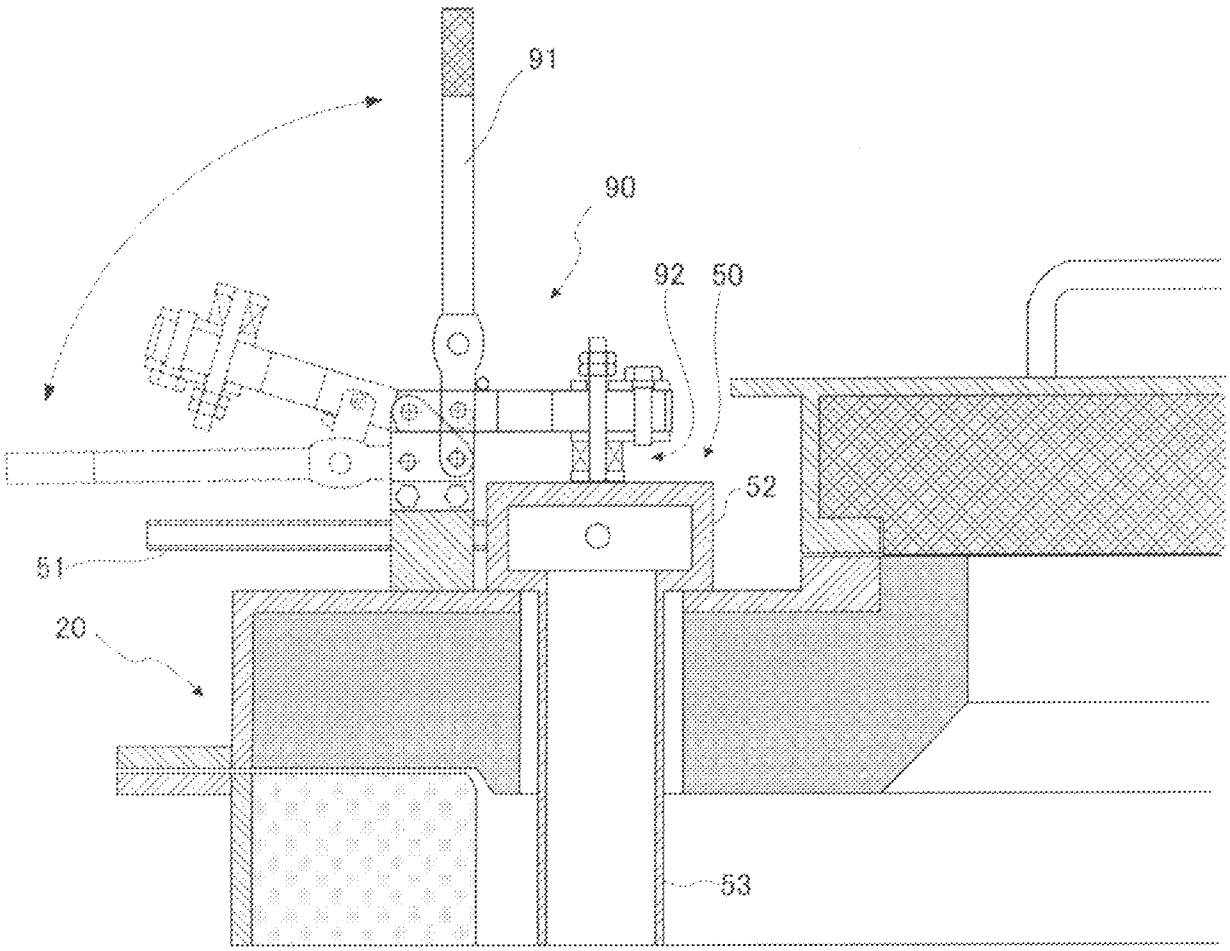
[Fig. 12]

LADLE FOR MOLTEN METAL DELIVERY

CROSS REFERENCE TO RELATED APPLICATIONS

This application is a U.S. national stage application of PCT/JP2007/055993 filed on Mar. 23, 2007, and claims priority to, and incorporates by reference, Japanese Patent Application Nos. 2006-082515 filed on Mar. 24, 2006 and 2006-123089 filed on Apr. 27, 2006.

TECHNICAL FIELD

The present invention relates to a pressure-tapping type ladle for transferring molten metal, for use in transferring and supplying melted metals such as molten aluminum to a molten metal-holding furnace in a molten metal-casting facility.

BACKGROUND ART

When conducting aluminum casting, etc., at a foundry, it is energy inefficient to remelt aluminum solidified into an ingot after being rendered molten by a manufacturer. Therefore, molten metal (melted metal) produced by a manufacturer is delivered to a foundry in molten form using a molten metal-transferring ladle. Examples include the molten metal-transferring ladle disclosed in Patent Document 1.

The molten metal-transferring ladle of Patent Document 1 is a pressure-tapping type molten metal-transferring ladle. As shown in FIG. 11, the ladle includes a ladle body 101 for containing melted metal; a large lid 102 covering the ladle body 101, an openable small lid 104 covering an inlet 103 provided in the middle portion of the large lid 102; a gas inlet 105 provided with the small lid 104 for pressurizing the surface of the melted metal (the molten metal surface) in the ladle; and a tapping portion 106 provided in the ladle body 101. The inlet 103 is an opening for use in pouring melted metal into the ladle body 101, observing the interior, removing aluminum oxide and the like, cleaning, heating by burner, etc.

For tapping melted metal, a pressurized gas supplying device is first connected to the gas inlet 105, and a pressurizing gas is introduced into a molten metal-transferring ladle to pressurize the molten metal surface, thereby supplying melted metal to a local furnace for a die-casting machine, etc., from a tap hole 107 of a tapping portion 106.

Patent Document 1: Japanese Unexamined Patent Publication No. 2002-254158

DISCLOSURE OF THE INVENTION

However, the aforementioned molten metal-transferring ladle has the following drawback. Since the gas inlet is provided on the small lid covering the inlet, the small lid is very heavy. This makes it difficult to open and close the small lid when pouring melted metal into the ladle body, observing the interior, removing aluminum oxide and the like, cleaning, heating by burner, and the like. Another drawback is that since the gas inlet is provided on the small lid covering the inlet formed in the middle of the large lid, it is difficult for the gas inlet to connect with the pressurized gas supplying device, reducing work efficiency. Still another drawback is that since connecting the gas inlet and the pressurizing gas supplying device must be done close to the high-temperature molten metal-transferring ladle containing the molten metal, there is a high risk of getting burned.

When a molten metal-transferring ladle containing molten metal is transported to a foundry by a truck or like conveyance, the molten metal surface may undulate greatly due to rough road surfaces or curves taken at street corners. This may cause the molten metal to splash accidentally, causing it to adhere to the gas inlet. The thus-adhered melted metal then cools and solidifies, clogging the gas inlet. This clogging of the gas inlet makes it difficult to guide a pressurizing gas into the molten metal-transferring ladle, and resultantly hinders the tapping of the melted metal. In the worst case, clogging makes it impossible to tap the melted metal.

The invention has been made to solve the above-described problems, and aims to provide a pressure-tapping type molten metal-transferring ladle that is safe and that has excellent workability, and can reliably introduce a pressurizing gas.

METHODS FOR SOLVING THE PROBLEMS

The object of the present invention can be achieved by a molten metal-transferring ladle that includes a ladle body having a storage space for a melted metal, and an opening on the top; a large lid having an inlet in the middle, and covering an upper opening of the ladle body; an openable small lid covering the inlet; a tapping portion communicating the interior with the exterior of the storage space; and a pressurizing gas supplying means supplying a pressurizing gas to the storage space; the large lid including a supplying means installing hole communicating the interior with the exterior of the storage space; and the pressurizing gas supplying means detachably mounted to the supplying means installing hole.

It is preferable that the molten metal-transferring ladle further include a supplying means installing device having a handle lever, and a pressurization member communicating with the handle lever via a linkage. It is preferable that the pressurizing gas supplying means detachably mounted to the supplying means installing hole by applying and releasing pressure using the pressurization member along with the operation of the handle lever.

It is preferable that the pressurizing gas supplying means extend to the storage space, and include a delivery pipe, the lower portion of which can be immersed in the melted metal retained in the storage space. The delivery pipe is preferably structured to release a pressurizing gas from the lower portion thereof.

It is preferable that the delivery pipe include a first regulating member and a second regulating member each provided in the upper portion and the lower portion of the delivery pipe, and a float placed between the first regulating member and the second regulating member. The float may block the delivery pipe when in contact with the first regulating member, whereas the float may not block the delivery pipe when in contact with the second regulating member.

It is further preferable that the pressurizing gas supplying means include a discharge hole for discharging the pressurizing gas to the storage space, and a discharge hole protecting member. The discharge hole is preferably provided with the upper portion of the discharge hole protecting member.

It is preferable that the pressurizing gas supplying means include a gas discharging portion releasing the pressurizing gas to the storage space. The gas discharging portion is preferably comprised of a gas-permeable fireproof material.

It is preferable that the pressuring gas supplying means include a gas discharging portion releasing the pressurizing gas to the storage space. The gas discharging portion is preferably comprised of a gas-permeable fireproof material.

EFFECT OF THE INVENTION

The present invention can provide a pressure tapping type molten metal-transferring ladle that is safe and has excellent workability, and is capable of reliably introducing a pressurizing gas.

DETAILED DESCRIPTION OF THE DRAWINGS

FIG. 1 is a cross-sectional view of a molten metal-transferring ladle according to one embodiment of the present invention.

FIG. 2 is a partial enlarged cross-sectional view of the molten metal-transferring ladle of FIG. 1.

FIG. 3 is a partial enlarged cross-sectional view showing a modified example of the molten metal-transferring ladle of FIG. 1.

FIG. 4 is a partial enlarged cross-sectional view showing another modified example of the molten metal-transferring ladle of FIG. 1.

FIG. 5(*a*) is a cross-sectional view taken along the line A-A of FIG. 4, and FIG. 5(*b*) is a cross-sectional view taken along the line B-B of FIG. 4.

FIG. 6 is an illustration showing the operation of the molten metal-transferring ladle of FIG. 4.

FIG. 7 is a partial enlarged cross-sectional view showing a modified example of the molten metal-transferring ladle of FIG. 4.

FIG. 8 is a partial enlarged cross-sectional view showing another modified example of the molten metal-transferring ladle of FIG. 1.

FIG. 9 is a cross-sectional view of a double circular tube comprised of the molten metal-transferring ladle of FIG. 8.

FIG. 10 is a partial enlarged cross-sectional view showing another modified example of the molten metal-transferring ladle of FIG. 1.

FIG. 12 is a partial enlarged cross-sectional view showing still another modified example of the molten metal-transferring ladle of FIG. 1.

Figure 11:
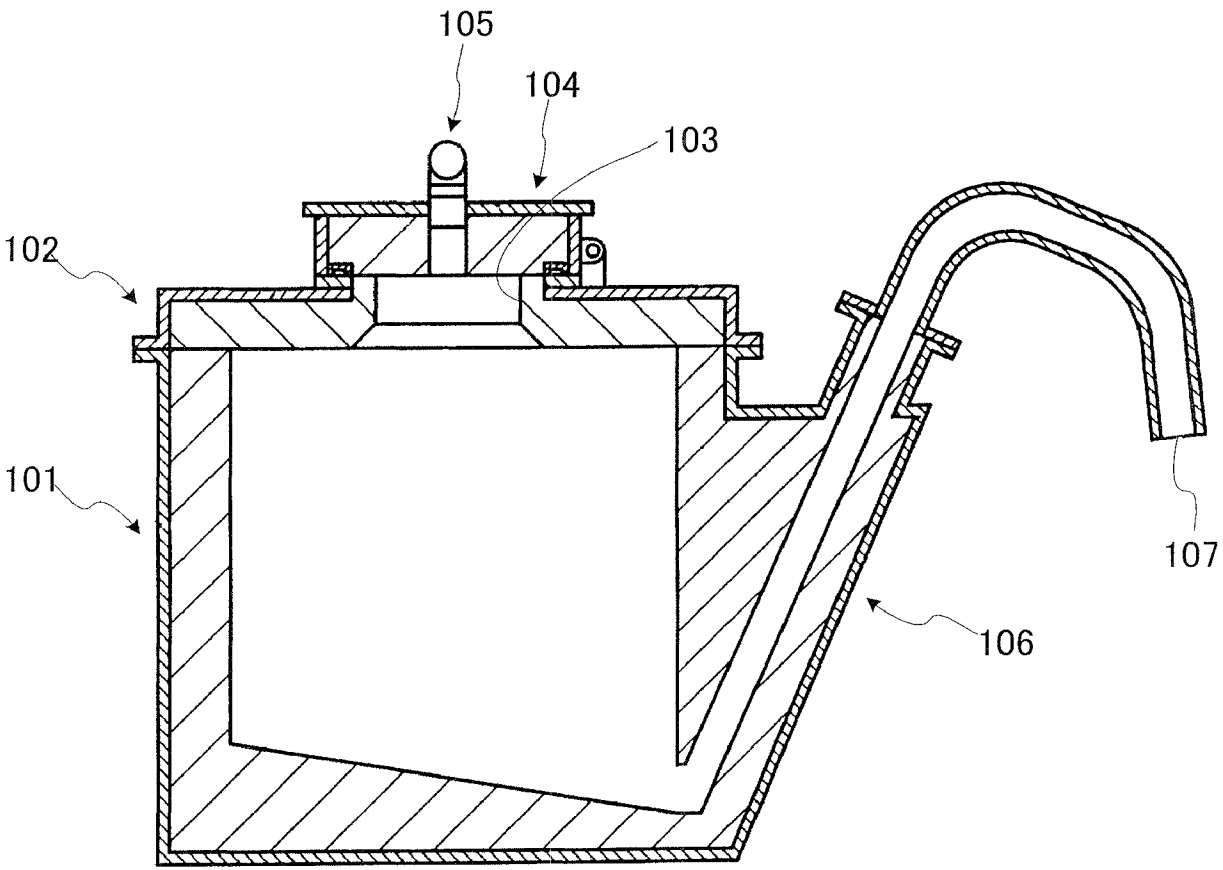
Fig. 11 PRIOR ART
FIG. 11 is a cross-sectional view of a known molten metal-transferring ladle.

| EXPLANATION OF REFERENCE NUMERALS | |
|---|---|
| 1) | molten metal-transferring ladle |
| 10) | ladle body |
| 10a) | top opening |
| 11) | storage space |
| 20) | large lid |
| 24) | inlet |
| 25) | supplying means installing hole |
| 30) | small lid |
| 40) | tapping portion |
| 50) | pressurizing gas supplying means |
| 51) | connecting pipe |
| 52) | connect portion |
| 53) | delivery pipe |

BEST MODE FOR CARRYING OUT THE INVENTION

Hereafter, the molten metal-transferring ladle of the invention is explained in detail with reference to the attached drawings. FIG. 1 shows a cross-sectional view of a molten metal-transferring ladle according to one embodiment of the present invention. As shown in FIG. 1, a molten metal-transferring ladle 1 includes a ladle body 10, a large lid 20, a small lid 30, a tapping portion 40, and a pressurizing gas supplying means 50.

The ladle body 10 is a container including a storage space 11 of molten metal (melted metal), and an opening 10*a* on the top; and is formed by lining an outer shell 12 made from a metal such as steel with a fireproof layer 13 formed of a thermal insulation material and a fireproof material. Examples of thermal insulation materials include heat-insulating bricks, ceramic fiber-type felts, heat-insulating boards, mortar, and the like. Examples of fire-resistant materials include fireproof bricks, castable refractories, plastic refractories, and the like. A pair of fork lift slots 14 are provided with the base of the ladle body 10. Each fork lift slot 14 of the pair of fork lift slots 14 has a fork pocket 14*a*, through which the fork portion of a forklift are inserted.

The large lid 20 is a lid covering the top opening 10*a* of the ladle body 10, and formed by lining the outer shell 22, made from a metal such as steel, with a fireproof layer 23 formed of the thermal insulation material and fireproof material, as in the ladle body 10 described above. In the middle of the large lid 20, the inlet 24, for use in pouring melted metal into the storage space 11 of the ladle body 10, observing the interior, removing aluminum oxide and the like, cleaning, heating by burner, etc, is provided. The large lid 20 includes a supplying means installing hole 25 communicating the interior with the exterior of the storage space 11. The supplying means installing hole 25 is located between the periphery of the opening of the inlet 24 and the outer edge of the large lid.

A heat-resistant (for example, carbon-based) sealing material, etc. is used to substantially seal the area between the large lid 20 and the ladle body 10. This sealing is sufficient enough to allow the ladle body inside 10 to withstand the pressure applied when pressurizing gas such as compressed air is supplied to the storage space 11 via the pressurizing gas supplying means 50. A certain amount of gas leakage is acceptable, insofar as control of the pressure inside the ladle is not hindered.

The small lid 30 is an openable lid covering the inlet 24 provided on the large lid 20, and is formed by lining the outer shell 32, made from a metal such as steel, with a fireproof layer 33 formed of the thermal insulation material and fireproof material, as in the ladle body 10 mentioned above. A heat-resistant (for example, carbon-based) sealing material, etc. is used to substantially seal the area between the small lid 30 and the large lid 20.

The tapping portion 40 communicates the interior with the exterior of the storage space 11 of the ladle body 10, and includes a discharging channel 41 that is capable of releasing the melted metal in the storage space 11 to the outside of the ladle body by applying pressure to the storage space inside 11 via the pressurizing gas supplying means 50, as mentioned later. The discharging channel 41 has an inner diameter of 90 mm, for example. The tapping portion 40 extends upward from the bottom of the ladle body 10, and a pouring spout 45 is connected to the upper opening of the tapping portion 40. The pouring spout 45 is bent in two locations so that a discharge opening 46, from which the melted metal is discharged, faces downward.

The pressurizing gas supplying means 50 is a means guiding a gas for pressurizing the molten metal surface of the melted metal in the storage space 11 to the storage space 11, and is removably provided with the supplying means installing hole 25 formed in the large lid 20 via bolts or the like. As illustrated in a partial enlarged cross-sectional view in FIG. 2, the pressurizing gas supplying means 50 includes an L-type connecting pipe 51, a connect portion 52, and a delivery pipe 53 to be inserted into the supplying means installing hole 25.

The connecting pipe 51 is connected to a pipe extended from a pressurized gas supplying device (not shown), and mounted on the connect portion 52.

The connect portion 52 is a cylindrical member having an internal space 52*a* and a connecting flange 52*b* that includes bolt-holes for fastening bolts at the outer periphery of the bottom portion.

The delivery pipe 53 is a circular pipe member extending toward the storage space 11. The delivery pipe includes the lower portion 53*b*, which can be immersed in the melted metal in the storage space 11, and the delivery pipe flange 53*a*, which is formed at the outer periphery of the upper portion. The delivery pipe flange 53*a* is configured to be in contact with the upper surface of the large lid 20 when the pipe 53 is installed in the supplying means installing hole 25.

When the delivery pipe 53 is made of metal, it is preferable to use a metal pipe coated with a corrosion antioxidant agent, or to apply a fireproof material such as silicone nitride to the surface of the metal tube so that melting damage can be prevented when the pipe touches the melted metal.

The delivery pipe 53 may be made of ceramics. Such a composition improves the heat resistance of the delivery pipe 53, and avoids situations in which the metal of the delivery pipe 53 melts and mixes into the molten metal in the storage space 11. This maintains the quality of the molten metal in the storage space 11.

The connecting pipe 51, connect portion 52, and delivery pipe 53 communicate with each other, and are designed such that a pressurizing gas guided from the pressurized gas supplying device (not shown) passes through the connecting pipe 51, connect portion 52, and delivery pipe 53 in that order, and is emitted from the lower portion 53*b* of the delivery pipe 53. In most cases, air is used as a pressuring gas, but inert gases such as nitrogen gas, argon gas, etc. may also be used.

The operation of the embodiment of the molten metal-transferring ladle 1 is explained below. First, the small lid 30 is opened, and melted metal is poured from the inlet 24 to the storage space 11 of the ladle body 10. After the supplying operation of the melted metal is completed, the small lid 30 is closed. Since the small lid 30 does not include the pressurizing gas supplying means 50, the lid 30 is light enough to easily open and close. When the melted metal is placed in the storage space 11, the lower portion 53*b* of the delivery pipe 53 is immersed in the melted metal Z of the storage space 11.

The molten metal-transferring ladle 1 containing the melted metal is transported by a truck or like conveyance to a local furnace for a die-casting machine, etc., where the casting is performed. When a truck, etc., travels on a public road, the molten metal surface of the melted metal may undulate greatly due to the rough road surfaces or curves taken at street corners. This may accidentally splash the melted metal; however, since the lower portion 53*b* of the delivery pipe 53, from which a pressurizing gas is discharged, is immersed in the melted metal Z, the splashed melted metal will not block the delivery pipe 53. The melted metal into which the lower portion 53*b* of the delivery pipe 53 is immersed is in a liquid state during transportation, and thus the melted metal will not solidify and clog the delivery pipe 53.

When the melted metal is supplied to a local furnace for a die-casting machine, etc., the pressurized gas supplying device is connected to the pressurizing gas supplying means 50, thereby introducing a pressurizing gas such as condensed air into the pressurizing gas supplying means 50. Since the pressurizing gas supplying means 50 is provided on the supplying means installing hole 25 between the periphery of the opening of the inlet 24 formed in the middle of the large lid 20 and the outer edge of the large lid 20, the pressurizing gas supplying means 50 is within easy reach and can be readily connected with the pressurized gas supplying device. Further, the means do not have to be connected adjacently; i.e., connecting can be conducted at a certain distance from the high-temperature molten metal-transferring ladle 1 containing melted metal, reducing the danger of burns or other injuries.

The pressurizing gas supplied into the pressurizing gas supplying means 50 is discharged into the melted metal Z via the delivery pipe 53, and then moved to the upper surface of the melted metal Z, i.e., a space 1 la, by its buoyancy to pressurize the molten metal surface S of the melted metal. By pressurizing the molten metal surface S, the melted metal Z is pushed out from the tapping portion 40 and then supplied into the local furnace.

Since the melted metal entering the delivery pipe 53 is pushed out from the end portion by a pressurizing gas flowing through the delivery pipe 53, clogging of the delivery pipe 53 caused by the solidified melted metal will not occur.

As described above, since the molten metal-transferring ladle 1 of the embodiment includes the pressurizing gas supplying means 50 between the outer edge of the large lid 20 and the periphery of the opening of the inlet 24 formed in the middle of the large lid 20, rather than the small lid 30, the small lid 30 can be easily opened and closed for pouring melted metal into the storage space 11 of the ladle body 10, observing the interior, removing aluminum oxide and the like, cleaning, heating by burner, and the like. Further, when the pipe extending from the pressurized gas supplying device is connected to the pressurizing gas supplying means 50, the pressurizing gas supplying means 50 is within easy reach, which allows for high work efficiency. Additionally, the connecting operation can be carried out far from the high-temperature molten metal-transferring ladle 1, avoiding injuries such as burns.

Further, the end portion 53*b* of the delivery pipe 53, from which the pressurizing gas is discharged, is immersed in the melted metal. This setup avoids the clogging of the delivery pipe 53 caused by the solidifying of the melted metal splashed during conveyance. Resultantly, a pressurizing gas can be reliably introduced into the storage space 11, enabling reliable tapping of the melted metal.

Since the gas supplying means 50 is removably provided on the supplying means installing hole 25 that is formed in the large lid 20, the gas supplying means 50 can, prior to feeding the melted metal into the storage space 11 of the ladle body 10, be removed from the large lid 20 to check for solidified melted metal adhered to the gas supplying means 50. Adhered solidified melted metal can be removed ahead of time, if observed. Thus, it is possible to prevent discharge failure from occurring during tapping of the melted metal at the local furnace for a die-casting machine, etc.

Although one embodiment of the present invention has been described herein, embodiments of the present invention are not limited thereto. As shown in FIG. 3, for example, a gas exhaust hole 53*c* that communicates interior with the exterior of the delivery pipe 53 can be formed on the upper portion of the delivery pipe 53. According to this configuration, the pressurizing gas is supplied into the storage space 11 via the gas exhaust hole 53*c*, and thus the molten metal surface S of the melted metal Z is efficiently pressurized, improving the discharge efficiency of the melted metal.

In the embodiment, bolts are used for detachably mounting the pressurizing gas supplying means 50 to the supplying means installing hole 25. However, the structure is not limited to this, and a one-touch removable coupler may be used for installation, for example.

Further, in the present embodiment, the delivery pipe 53 may include a float 61, a first regulating member 62, and a second regulating member 63 (FIG. 4 and FIG. 5). FIG. 4 is a partial enlarged cross-sectional view of the molten metal-transferring ladle 1. FIG. 5(*a*) is a cross-sectional view taken along the line A-A of FIG. 5, and FIG. 5(*b*) is a cross-sectional view taken along the line B-B of FIG. 5.

The first regulating member 62 and the second regulating member 63 are located at regular intervals in the upper and lower portions of the delivery pipe 53. The float 61, which is movable inside the delivery pipe 53, is contained between the first regulating member 62 and the second regulating member 63. The first regulating member 62 and the second regulating member 63 are members that limit the movement of the float 61 in the delivery pipe 53. As illustrated in FIGS. 4 and 5(*a*), the first regulating member 62 includes at the center of a flat member a round-shaped through-hole 62*a* as seen in a plane view. As shown in FIG. 5(*b*), the second regulating member 63 is a stick-type member located in the bottom of the delivery pipe 53, and which partially blocks the flow of the delivery pipe.

The float 61 obstructs the delivery pipe 53 when it is in contact with the first regulating member 62, whereas the float does not block the delivery pipe 53 when it is in contact with the second regulating member 63. Examples of the float include a spherical member that is floatable in the melted metal contained in the storage space 11. The float 61 formed of a spherical member is designed to have a diameter small enough to provide a space between the inside wall of the delivery pipe and the float, and larger than that of the through-hole 62*a* provided on the first regulating member 62. The float 61 is preferably formed into a hollow spherical shape using fireproof materials such as ceramics.

In supplying the melted metal into a local furnace for a die-casting machine, a pressurizing gas guided to the connecting pipe 51 and the internal space 52*a* of the connect portion 52 is first directed to the delivery pipe 53, and then passes through the space between the float 61 and the inner wall of the delivery pipe 53 via the through-hole 62*a* of the first regulating member 62. The gas is finally released from the lower portion 53*b* of the delivery pipe 53, thereby reaching the storage space 11.

This configuration reliably prevents the entrance of the melted metal Z into the connecting pipe 51 or connect portion 52, even when the molten metal surface S of the melted metal Z is greatly inclined relative to the molten metal-transferring ladle 1 when, for example, a truck loaded with a melted metal-containing ladle 1 hits a steep gradient. Hereinafter, details are provided with reference to FIG. 6. FIG. 6 is a partial enlarged cross-sectional view showing a situation in which the molten metal surface S of the melted metal Z is greatly inclined relative to the molten metal-transferring ladle 1. When the molten metal surface S of the melted metal Z is greatly inclined, the spherical float 61 moves upward in the delivery pipe 53 along with the liquid level change of the melted metal (as indicated by arrow C) to contact the first regulating member 62 that limits the upward movement of the float 61. In this case, the outer surface of the spherical float 61 is in contact with the inner periphery of the through-hole 62*a* of the first regulating member 62, which blocks the delivery pipe 53. This prevents the entry of the melted metal Z, which enters the delivery pipe 53 from the bottom opening of the delivery pipe 53, into the upper portion of the first regulating member 62, thereby preventing the entry of the melted metal into the connect portion 52 or connecting pipe 51, located in the upper portion of the first regulating member 62. As a result, clogging of the connecting pipe 51 and internal space 52*a* of the connect portion 52, due to the solidification of the melted metal Z, can be completely prevented, preventing introduction failure of the pressurizing gas into the storage space 11 caused by the clogging of the solidified melted metal Z in the connect portion 52 or connecting pipe 51.

A float 61 of FIGS. 4 to 6 has a spherical shape, but any shape, such as a cone shape, can be used.

The first regulating member 62 is a flat plate; however, as shown in FIG. 7, the first regulating member may have an inclined surface 62*b* wherein the undersurface of the flat plate inclines downwardly from an inner periphery of the through-hole to the outer surface of the flat plate member. When the molten metal surface of the melted metal is inclined greatly enough relative to the ladle to raise the float 61 in the delivery pipe 53, this arrangement allows the outer surface of the float 61 to reliably adhere to the inner periphery of the through-hole 62*a*, since the float 61 is guided to the through-hole 62*a* along the inclined surface 62*b* of the first regulating member 62. As a result, the delivery pipe 53 can be completely blocked, and thus entry of the melted metal Z into the connect portion 52 or connecting pipe 51 can be reliably prevented.

In the embodiment of the invention, the pressurizing gas supplying means 50 includes the delivery pipe 53 (FIG. 1); however, a discharging pipe 70 and a discharge hole protecting member 75 can be provided in place of the delivery pipe 53 (FIG. 8).

The discharging pipe 70 includes a double circular tube 71 installed in the supplying means installing hole 25. The double circular tube 71 serves as a discharge hole releasing a pressurizing gas into the storage space 11. In the inner tube 72 and the outer tube 73 of the double circular tube 71, long holes 72*a* and 73*a* passing through the inside and outside of the tube are disposed at four locations along the circumferential direction. These long holes 72*a* and 73*a* also serve as discharge holes for releasing a pressurizing gas to the storage space 11. As shown in the cross-sectional view of FIG. 9, the long holes 72*a* and 73*a* each provided on the inner tube 72 and outer tube 73 are arranged in a single layer at regular intervals. The discharging pipe flange 74 is formed around the upper portion of the inner tube 72, and the top portion of the outer tube 73 is fixed to the discharging pipe flange 74. The discharging pipe flange 74 is structured to attach to the upper surface of the large lid 20 when the discharging pipe 70 is placed in the supplying means installing hole 25.

A pressurizing gas guided to the connecting pipe 51 and the internal space 52*a* of the connect portion 52 is directed to the storage space 11 via one of the following three pathways: the lower portion of the inner tube 72 of the discharging pipe 70; the lower portion of the flow path between the inner wall of the outer tube 73 and the outer wall of the inner tube 72; or the long holes 72*a* and 73*a* each provided on the inner tube 72 and outer tube 73.

The discharge hole protecting member 75 is located under the double circular tube 71, and fixed to the outer surface of the outer tube 73 via a fixing member 76. The discharge hole protecting member 75 inclines downward from the central part to the outside, and is almost in the shape of a straw hat. The member does not necessarily incline downwardly in a linear manner, but may incline downwardly in a curved manner, or the like.

Since the double circular tube 71 (discharge hole) is located above the discharge hole protecting member 75, even if the melted metal Z splashes in the storage space 11 during transportation, the discharge hole protecting member 75 blocks the melted metal Z and prevents its adhesion to the discharge hole. As a result, clogging of the discharging pipe 70 caused by the solidified melted metal Z can be prevented, thereby reliably introducing a pressurizing gas into the storage space 11.

Further, since the discharge hole protecting member 75 inclines downward from its central part to the outside, even if the melted metal Z splashes over the discharge hole protecting member 75, the melted metal Z readily flows downward, preventing the collection of solidified melted metal on the member.

Since the long holes 72*a* and 73*a* are formed around the double circular tube, even if the lower portion of the discharging pipe 70 is clogged by solidified melted metal, inhibiting the introduction of the pressurizing gas into the storage space 11 via the aperture, the pressurizing gas can be guided to the storage space 11 via the long holes 72*a* and 73*a* formed on the inner tube 72 and outer tube 73, thereby reliably pressurizing the inside of the storage space 11.

Even if some of the long holes 72*a*, 73*a* are clogged by the splashed melted metal Z, the pressurizing gas can be supplied into the storage space 11 via other long holes 72*a* and 73*a*.

Further, as shown in FIG. 9, since the long holes 72*a* and 73*a* disposed on the inner tube 75 and outer tube 76 are located on a single layer, even if the splashed melted metal Z passes through the long hole 73*a* on the outer tube 73 to the inner tube side 72, adherence of the melted metal Z to the long hole 72*a* formed on the inner tube 72 can be prevented. Therefore, the long hole 72*a* on the inner tube 72 can avoid becoming clogged by the solidified melted metal Z.

In FIG. 8, the discharge hole protecting member 75 widens downward from the top to the outside; however, the member may also be in the form of a flat plate.

Further, in the present embodiment, the pressurizing gas supplying means 50 includes a delivery pipe 53 (FIG. 1); however, as shown in FIG. 10, the means may be designed to accommodate a gas discharging portion 80 releasing a pressurizing gas to the storage space 11, in place of the delivery pipe 53.

The gas discharging portion 80 is a cylindrical member to be installed in the supplying means installing hole 25, and is covered by a gas-permeable fireproof material 81. A holding flange 82 is provided on the upper edge of the outer surface of the gas discharging portion 80. The holding flange 82 is structured to attach to the upper surface of the large lid 20, when the gas discharging portion 80 is installed in the supplying means installing hole 25. A pressurizing gas guided to the connecting pipe 51 and the internal space 52*a* of the connect portion 52 permeates to the storage space 11 via the gas-permeable fire-resistant material 81 of the gas discharging portion 80, thereby pressurizing the molten metal surface S of the melted metal Z.

Examples of the gas-permeable fire-resistant material 82 include an alumina, mullite (silica-alumina), silica, calcium silicate, and non-oxide-based porous sintered materials such as silicon carbide.

According to the arrangement above, even when a portion of the gas-permeable fire-resistant material 81 is clogged, the pressurizing gas can permeate through other parts of the material 81, and can be reliably introduced into the storage space. Therefore, discharge failure of the melted metal Z can be prevented.

Because the storage space 11 is separated from the internal space 52*a* by the gas-permeable fire-resistant material 81, even when the molten-metal surface S of the melted metal Z accommodated in the storage space 11 greatly inclines, the entry of the melted metal Z to the connect portion 52 and the connecting pipe 51 can be prevented. Therefore, it is possible to prevent the adherence of the solidified melted metal Z to the connect portion 52 and the connecting pipe inside 51, which causes poor circulation of the pressurizing gas.

In an embodiment of the invention, the pressurizing gas supplying means 50 is removably set in the supplying means installing hole 25 via bolts (FIG. 2); however, as shown in the partial enlarged cross-sectional view of FIG. 12, the pressurizing gas supplying means 50 may be removably set in the supplying means installing hole 25 using a supplying means installing device 90. The supplying means installing device 90 includes an rotatable handle lever 91 to be held by an operator, and a pressurizing member 92 connected to the handle lever 91 via a linkage. The pressurizing gas supplying means 50 is detachably mounted to the supplying means installing hole 25 by applying or releasing the pressure on the supplying means, using the pressurizing member 92 along with the operation of the handle lever 91. Examples of the supplying means installing device 90 include a toggle clamp, a cam clamp, etc. This structure enables the operator to easily lock or unlock the pressurizing gas supplying means 50 to the supplying means installing hole 25 by simply pulling the hand lever 91 down or up. FIG. 12 shows that the connect portion 52 is integrally formed with the delivery pipe 53, that a connecting pipe 51 is provided on the side of the connect portion 52, and that the entire outer circumference of the connect portion 52 is in contact with the upper surface of the large lid 20 in the vicinity of the supplying means installing hole 25. Further, sealing material such as packing can be used between the entire outer circumference of the connect portion 52 and the upper surface of the large lid 20 in the vicinity of the supplying means installing hole 25. This reliably prevents pressurizing gas leakage from the space between the entire outer circumference of the connect portion 52 and the upper surface of the large lid 20.

The invention claimed is:

1. A molten metal-transferring ladle comprising:

a ladle body having a storage space for melted metal, and an opening on the top;

a large lid having an inlet in the middle, and covering an upper opening of the ladle body;

an openable small lid covering the inlet;

a tapping portion communicating the interior with the exterior of the storage space;

a supplying means installing hole that is provided at the large lid and communicates the interior with the exterior of the storage space;

a tubular pressurizing gas supplying means that is detachably attached to the supplying means installing hole and guides a pressurizing gas supplied from one end to the storage space via the other end; and a supplying means installing device having a handle lever, and a pressurization member communicating with the handle lever via a linkage, the pressurizing gas supplying means being detachably mounted to the supplying means installing hole by applying and releasing pressure using the pressurized member along with the operation of the handle lever.

2. The molten metal-transferring ladle according to claim 1, wherein the tubular pressurizing gas supplying means comprises a discharge hole for discharging the pressurizing gas to the storage space, and a discharge hole protecting member, wherein the discharge hole is provided with the upper portion of the discharge hole protecting member.

3. The molten metal-transferring ladle according to claim 1, wherein the tubular pressurizing gas supplying means comprises a gas discharging portion releasing the pressurizing gas to the storage space, wherein the gas discharging portion is comprised of a gas-permeable fireproof material.

4. A molten metal-transferring ladle comprising:

a ladle body having a storage space for melted metal, and an opening on the top;

a large lid having an inlet in the middle, and covering an upper opening of the ladle body;

an openable small lid covering the inlet;

a tapping portion communicating the interior with the exterior of the storage space;

a supplying means installing hole that is provided at the large lid and communicates the interior with the exterior of the storage space; and a tubular pressurizing gas supplying means that is detachably attached to the supplying means installing hole and guides a pressurized gas supplied from one end of the storage space via the other end; and the tubular pressurizing gas supplying means extending to the storage space, and including a delivery pipe, the lower portion of which can be immersed in the melted metal retained in the storage space, and the delivery pipe releases a pressurizing gas from the lower portion thereof.

5. The molten metal-transferring ladle according to claim 4, wherein the delivery pipe comprises a first regulating member and a second regulating member each provided in the upper portion and the lower portion in the delivery pipe, and a float placed between the first regulating member and the second regulating member, wherein the float blocks the delivery pipe when in contact with the first regulating member, whereas the float does not block the delivery pipe when in contact with the second regulating member.

6. The molten metal-transferring ladle according to claim 4, wherein the tubular pressurizing gas supplying means comprises a discharge hole for discharging the pressurizing gas to the storage space, and a discharge hole protecting member, wherein the discharge hole is provided with the upper portion of the discharge hole protecting member.

7. The molten metal-transferring ladle according to claim 4, wherein the tubular pressurizing gas supplying means comprises a gas discharging portion releasing the pressurizing gas to the storage space, wherein the gas discharging portion is comprised of a gas-permeable fireproof material.

8. The molten metal-transferring ladle according to claim 4, wherein the delivery pipe comprises a first regulating member and a second regulating member each provided in the upper portion and the lower portion in the pipe, and a float placed between the first regulating member and the second regulating member, wherein the float blocks the delivery pipe when in contact with the first regulating member, whereas the float does not block the delivery pipe when in contact with the second regulating member.

* * * * *